US010858841B1

(12) United States Patent
Rockhold et al.

(10) Patent No.: US 10,858,841 B1
(45) Date of Patent: Dec. 8, 2020

(54) WIND-DRIVEN RAIN AND IMPACT RESISTANT LOUVER

(71) Applicant: AIR DISTRIBUTION TECHNOLOGIES IP, LLC, Milwaukee, WI (US)

(72) Inventors: Joseph S. Rockhold, Bates City, MO (US); Melissa M. Massar, Lee's Summit, MO (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 0 days.

(21) Appl. No.: 16/557,456

(22) Filed: Aug. 30, 2019

Related U.S. Application Data

(60) Provisional application No. 62/852,646, filed on May 24, 2019.

(51) Int. Cl.

| | |
|---|---|
| ***E04F 10/10*** | (2006.01) |
| ***F24F 13/08*** | (2006.01) |
| ***E06B 7/08*** | (2006.01) |
| ***F24F 13/18*** | (2006.01) |

(52) U.S. Cl.
CPC ..... *E04F 10/10* (2013.01); *E06B 7/08* (2013.01); *F24F 13/08* (2013.01); *F24F 13/082* (2013.01); *F24F 13/18* (2013.01); *F24F 2221/52* (2013.01)

(58) Field of Classification Search
CPC ..... F24F 13/18; F24F 13/082; F24F 13/08; F24F 2221/52; E06B 7/08; E04F 10/10
See application file for complete search history.

(56) References Cited

U.S. PATENT DOCUMENTS

| | | | | | |
|---|---|---|---|---|---|
| 2,555,626 | A * | 6/1951 | Avers | F24F 13/08 | 454/282 |
| 2,855,841 | A * | 10/1958 | Smith | B65B 35/54 | 454/279 |
| 2,987,985 | A * | 6/1961 | Johnson | F24F 13/08 | 454/277 |
| 3,180,462 | A * | 4/1965 | Grady | E06B 7/082 | 403/247 |
| 3,348,466 | A * | 10/1967 | Lane | F24F 13/08 | 454/282 |
| 3,580,160 | A * | 5/1971 | McCabe | F24F 13/08 | 454/282 |
| 3,584,566 | A * | 6/1971 | McCabe | F24F 13/075 | 454/359 |
| 3,771,430 | A * | 11/1973 | Lane | E06B 7/08 | 454/277 |
| 3,849,095 | A | 11/1974 | Regehr | | |
| 3,870,488 | A | 3/1975 | Arndt et al. | | |
| 4,103,468 | A * | 8/1978 | Olsen | F24F 13/08 | 52/473 |

(Continued)

*Primary Examiner* — Andrew J Triggs
(74) *Attorney, Agent, or Firm* — Fletcher Yoder, P.C.

(57) ABSTRACT

Described is a louver having a frame that forms an enclosure defining an opening, and a plurality of louver blades disposed within the opening. The louver further includes an elongated member disposed within the frame and in contact with the plurality of louver blades. The elongated member has a body that longitudinally extends between a first member end and a second member end, wherein the first member end and the second member end are fixedly connected to opposing sections of the frame. The described louver may provide improved wind-driven rain resistance and/or impact resistance.

18 Claims, 8 Drawing Sheets

(56) References Cited

U.S. PATENT DOCUMENTS

| | | | | | |
|---|---|---|---|---|---|
| 4,310,993 | A * | 1/1982 | White | E06B 7/082 | 454/277 |
| 4,958,555 | A * | 9/1990 | Lentz | F24F 13/08 | 454/277 |
| 5,297,373 | A * | 3/1994 | Olsen | E06B 7/082 | 52/473 |
| 5,542,224 | A * | 8/1996 | Olsen | F24F 13/08 | 52/473 |
| 5,839,244 | A * | 11/1998 | Johnson | F24F 13/08 | 52/473 |
| 5,906,083 | A * | 5/1999 | Olsen | E06B 7/08 | 454/277 |
| 5,950,384 | A * | 9/1999 | Aarness | F24F 13/075 | 454/277 |
| 6,149,515 | A * | 11/2000 | Van Becelaere | F24F 13/075 | 454/277 |
| 2008/0207112 | A1* | 8/2008 | Michieli | F24F 13/082 | 454/330 |
| 2010/0099349 | A1 | 4/2010 | Gohring et al. | | |
| 2015/0135661 | A1* | 5/2015 | MacDonald | B01D 45/08 | 55/440 |
| 2015/0345130 | A1* | 12/2015 | Worthing | E04B 1/7076 | 52/309.1 |
| 2017/0205110 | A1* | 7/2017 | Bruhnke | F24F 7/00 | |
| 2018/0149384 | A1 | 5/2018 | Rockhold et al. | | |
| 2019/0338984 | A1* | 11/2019 | Fang | E06B 7/03 | |

* cited by examiner

WIND-DRIVEN RAIN AND IMPACT RESISTANT LOUVER

CROSS-REFERENCE TO RELATED APPLICATION

This application claims the benefit of U.S. Provisional Application Ser. No. 62/852,646, entitled "WIND-DRIVEN RAIN AND IMPACT RESISTANT LOUVER" and filed on May 24, 2019, which is expressly incorporated by reference herein in its entirety.

BACKGROUND

Louvers are used to prevent egress of wind, rain, leaves, insects and other foreign materials into a heating, ventilation, and air conditioning (HVAC) system. Existing louvers may not provide sufficient protection against wind-driven rain and/or against impact by foreign materials.

Thus, improvements in louvers are desired.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

The present disclosure relates to a louver that may provide improved wind-driven rain resistance and/or impact resistance.

In one implementation, an example louver has a frame that forms an enclosure defining an opening, and a plurality of louver blades disposed within the opening. The louver further includes an elongated member disposed within the frame and in contact with the plurality of louver blades. The elongated member has a body that longitudinally extends between a first member end and a second member end, wherein the first member end and the second member end are fixedly connected to opposing sections of the frame.

In another implementation, an example louver has a frame including a first frame section and an opposing second frame section, and a third frame section and an opposing fourth frame section each connected at respective ends with corresponding ends of the first frame section and the second frame section to define an opening. The louver further includes a plurality of louver blades disposed within the opening of the frame. Additionally, the louver includes an elongated member having a body that longitudinally extends between a first member end and a second member end through the plurality of louver blades, wherein the first member end is fixedly attached to the first frame section and the second member end is fixedly attached to the second frame section, and wherein the elongated member is fixedly attached to each of the plurality of louver blades.

These and other features of the louver of the present disclosure are described in more detail below.

BRIEF DESCRIPTION OF THE DRAWINGS

The features believed to be characteristic of aspects of the disclosure are set forth in the appended claims. In the description that follows, like parts are marked throughout the specification and drawings with the same numerals. The drawing figures are not necessarily drawn to scale and certain figures may be shown in exaggerated or generalized form in the interest of clarity and conciseness. The disclosure itself, however, as well as a preferred mode of use and\further advantages thereof, will be best understood by reference to the following detailed description of illustrative aspects of the disclosure when read in conjunction with the accompanying drawings, wherein:

DETAILED DESCRIPTION

The present disclosure relates to a louver having improved wind-driven rain and impact resistance. In particular, the disclosed louver provides increased impact resistance by rigidly attaching a plurality of louver blades of the louver to the louver frame through an elongated member, such as but not limited to a rod. In one implementation, for example, at least one elongated member is disposed within the louver frame of the louver and extends through and is fixed to a body of each of the louver blades, and the opposing ends of the elongated member are fixed to opposing sides of the louver frame. As such, the force of any foreign material impacting one or more of the louver blades is distributed across the contact area between the elongated member and all of the plurality of blades, and then transferred to the louver frame. This configuration provides enhanced impact resistance as compared to other existing louver designs. In fact, a louver with the disclosed design has been shown to meet the flying projectile impact requirements of the Federal Emergency Management Agency (FEMA) P-361, Safe Rooms for Tornadoes and Hurricanes, Guidance for Community and Residential Safe Rooms document (hereinafter "the FEMA P-361 document").

Moreover, the disclosed louver includes a louver blade configuration having a plurality of peaks that aid in capturing wind-driven rain and channeling the water out of the louver without allowing it to pass through. A louver with the disclosed design has been shown to meet the criteria of the Air Movement and Control Association International, Inc. (AMCA) 550 standard for wind-driven rain resistance.

Additionally, the louver frame may further include at least one inner wall, which defines at least a part of the opening formed by the frame, and which may be configured to aid in draining capture water from the plurality of louver blades. In an implementation, for example, the at least one inner wall has a plurality of slots sized to receive the plurality of louver blades while maintaining a spaced apart gap, which allows any collected water to drain out of the airflow path and out of the louver.

These and other features of the disclosed louver will be discussed in more detail below.

Figure 1:
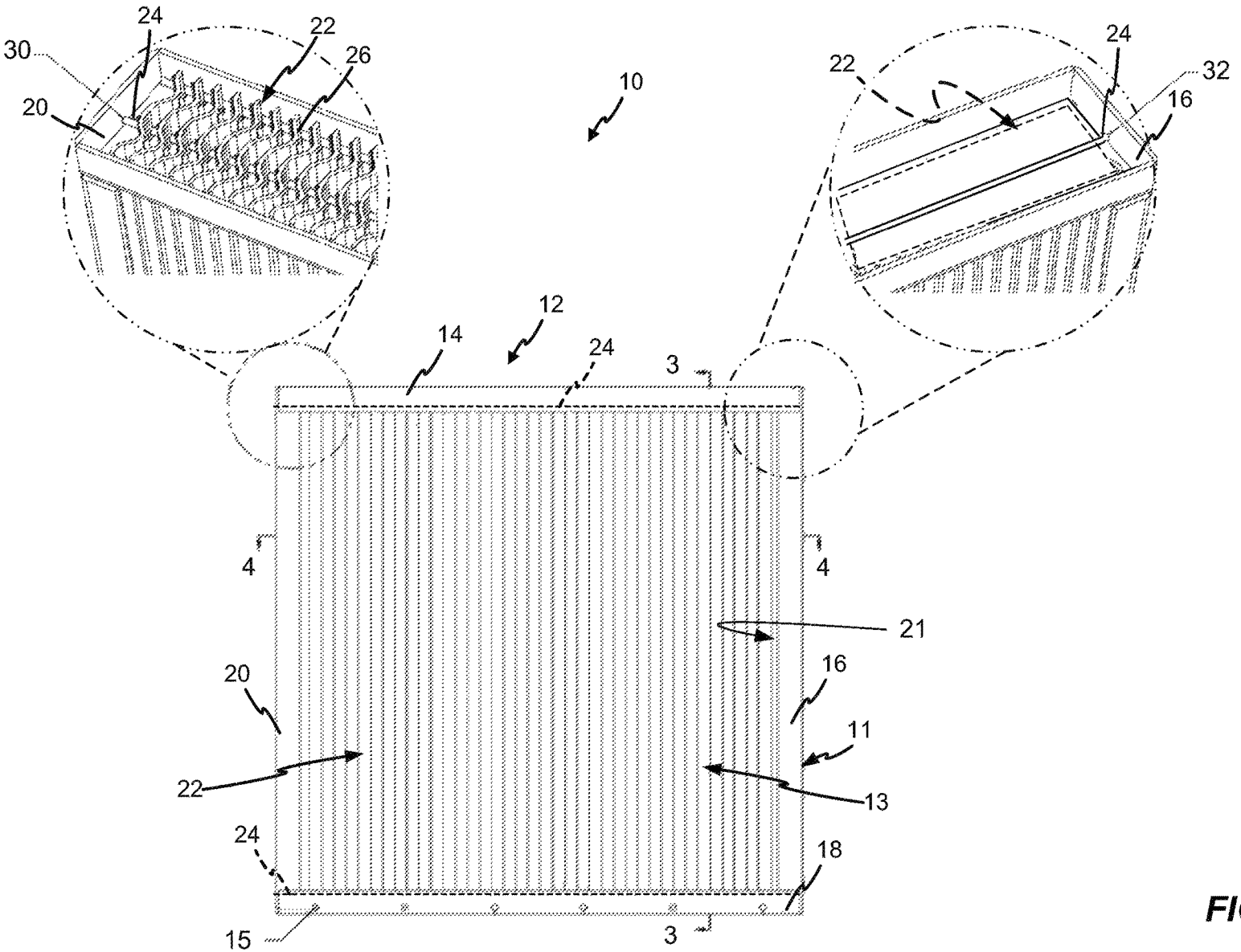
FIG. 1 is a front plan view of an example of the disclosed louver, including partial top perspective close-up views of the opposing ends of an elongated member attached to opposing sides of the louver frame, where the elongated member supports a plurality of louver blades of the louver within the louver frame.
Figure 2:
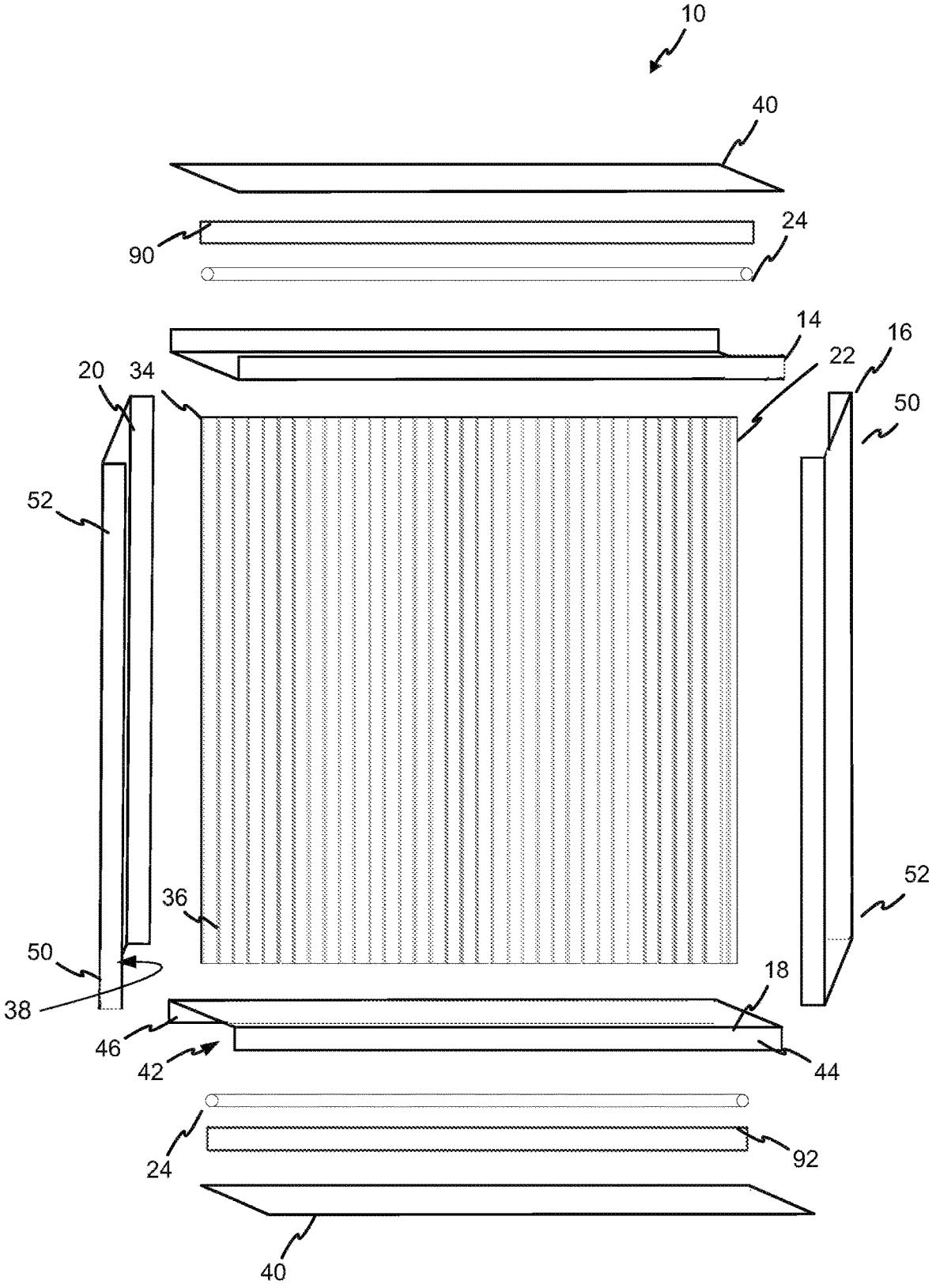
FIG. 2 is an exploded perspective view of the louver of FIG. 1.

Referring to FIGS. 1-11, an example louver 10 is configured for improved resistance to wind-driven rain and impacts by foreign materials. Referring primarily to FIGS. 1 and 2, the louver 10 includes a louver frame 12 having a plurality of frame sections, such as frame sections 14, 16, 18, and 20, which define an outer body 11 of the louver 10 and an inner air passage area 13. The inner air passage area 13 includes the space defined by inner surfaces 21 of the frame sections 14, 16, 18, and 20 through which air may pass from a front or forward side of the louver 10 to a rear or aft side of the louver 10. For example, in one application, the air may be received by an input of a heating, ventilation, and air conditioning (HVAC) system to which the louver 10 is positioned adjacent to or mounted. Also, in some cases, frame section 14 may be referred to as a head frame, frame sections 16 and 20 may be referred to as jamb frames, and frame section 18 may be referred to as a sill frame. Additionally, the louver 10 includes a plurality of louver blades 22 positioned within at least the inner air passage area 13 and configured to catch water carried by the air and carry the water to one or more drainage holes 15 at a base (e.g., frame section 18) of the louver 10, thereby minimizing or preventing passage of the water through the louver 10. The plurality of louver blades 22 are mounted to one or more of the frame sections 14, 16, 18, and 20 by one or more elongated members 24. In an implementation, the one or more elongated members 24 provide the sole support for the plurality of louver blades 22 within the frame 12. In other words, the one or more elongated members 24 may be the only connection or contact point between the plurality of louver blades 22 and the frame 12. The frame 12, the one or more elongated members 24, and the plurality of louver blades 22 may be formed from a substantially rigid material, such as a metal, a ceramic, a composite material, or any other material suitable for wind-driven rain resistance and impact resistance.

In an aspect, the one or more elongated members 24 are contactable with the plurality of louver blades 22 in order to disperse the force of an impact on any one or more of the plurality of louver blades 22. For instance, in an implementation, each elongated member 24 may be positioned through and in contact with a body 26 of each of the plurality of louver blades 22. Further, in an implementation, each elongated member 24 may be fixedly attached to each of the plurality of louver blades 22.

Additionally, each elongated member 24 includes a longitudinally extending body 28 extending between opposing member ends 30, 32, where each member end 30, 32 is respectively fixedly attached to an opposing surface or side of the frame 12. For example, in an implementation, member end 30 is fixedly attached to frame section 20, while member end 32 is fixedly attached to frame section 16. As used herein, the term fixedly attached or fixed attachment may include, but is not limited to, a weld, a mechanical fastener, a force fit, an adhesive, or any attachment mechanism or procedure. For instance, in the case of the fixed attachment of the member ends 30, 32 to opposing surfaces of the frame 12, e.g., frame sections 16 and 20, or in the case of the elongated member 24 being fixedly attached to the plurality of louver blades 22, the fixed attachment may include any mechanism or procedure that enables each elongated member 24 to have a sufficient connection to the frame 12 and/or to the plurality of louver blades 22 to transfer the force of an impact on one or more of the plurality of louver blades 22 through the elongated member 24 to the corresponding frame sections to enable the louver 10 to meet a predetermined impact resistance standard. For instance, the predetermined impact resistance standard may include an impact force corresponding to an impact resistance requirement, such as but not limited to an impact resistance standard defined in the FEMA P-361 document. Each elongated member 24 may have a circular cross section, a square cross section, a rectangular cross section, or any cross-section suitable for being fixedly attached to the plurality of louver blades 22 and/or the one or more frame sections 14, 16, 18, or 20, and/or for distributing force.

In some cases, the louver 10 may include a single elongated member 24, while in other cases the louver 10 may include a plurality of elongated members 24. For example, the number of elongated members 24 may be determined based on one or any combination of an expected amount of impact force to be dispersed, an amount of support required for the plurality of louver blades 22, and/or airflow considerations (e.g., minimizing the cross-sectional area of the one or more elongated members 24 within the inner air passage area 13).

Further, the one or more elongated members 24 may have any position relative to the body 26 of the plurality of louver blades 22 and/or the frame 12 sufficient to support the plurality of louver blades 22 with respect to at least one of the frame sections 14, 16, 18, and 20. In one implementation, for example, the louver 10 may include two elongated members 24 respectively positioned adjacent to opposing blade ends 34, 36 of the plurality of louver blades 22, which may help to provide support to each end of the plurality of louver blades 22. Further, in this case, the two elongated members 24 may be positioned outside of the inner air passage area 13 to avoid the elongated members 24 from obstructing airflow through the plurality of louver blades 22. For instance, the two elongated members 24 may be positioned within a body of a corresponding frame section, e.g., within frame sections 14 and 18 in the example of FIG. 1.

Referring specifically to FIGS. 1-5, in an implementation, one or more of the frame sections 14, 16, 18, and 20 of the frame 12, such as at least frame sections 14 and 18 that are adjacent to the blade ends 34, 36 (see FIGS. 2 and 3), may have an inner wall 38 spaced apart from an outer wall 40 to define an opening or channel 42 through the respective frame section in which the respective elongated member 24 may be positioned. Further, in this implementation, a portion of the blade ends 34, 36 through which the elongated members 24 extend may also be positioned within each respective channel 42. Moreover, in an implementation, one of more of the frame sections 14, 16, 18, and 20 of the frame 12 may additionally include a front wall 44 and a rear wall 46 to define the channel 42 (e.g., as in frame sections 16 and 20) or to close the channel 42 (e.g., as in frame sections 14 and 18), thereby defining a hollow structure that saves weight but provides sufficient strength to support the louver 10. The respective front walls 44 define a front face of the louver 10, and along with the respective inner walls 38 define the inner air passage area 13. The hollow or channel structure of the one of more of the frame sections 14, 16, 18, and 20 may have any shape, such as a rectangle, a square, a circle, a U-shape, or any other shape convenient for forming and supporting the louver 10. In one implementation, for example, the frame sections 14, 16, 18, and 20 may have U-shape, wherein a base of the U-shape for frame sections 14 and 18 may define a portion of the inner wall 38, wherein a base of the U-shape for frame sections 16 and 20 may define a portion of the outer wall 40 whereas the end surfaces of the opposite the base of the U-shape may define a portion of the inner wall 38.

Referring to FIG. 2, another aspect of the louver 10 that may aid in impact resistance is the placement and connection of the one or more elongated members 24 near connected ends of adjacent sections of the frame 12. For example, in an implementation, each frame section 14, 16, 18, and 20 includes a section body 48 that longitudinally extends between opposing frame ends 50, 52. Adjacent ones of the frame ends 50, 52 may be fixedly attached to one another to form the frame 12. For instance, frame end 52 of frame section 14 may be connected to frame end 50 of frame section 16, and so on. The fixed attachment of the opposing frame ends 50, 52 of adjacent frame sections may include, but is not limited to, a weld, a mechanical fastener, a force fit, an adhesive, or any attachment mechanism or procedure suitable for joining the opposing frame ends 50, 52 in a manner sufficient to support the louver 10 and resist disconnection in response to the louver 10 being impacted by an object that transfers a predetermined impact force, such as an impact force defined in the FEMA P-361 document. The placement of fixed attachment of the one or more elongated members 24 near the connected ends of adjacent frame sections thereby enables the transfer of a force of any impact to the plurality of louver blades 22 to be somewhat similarly distributed to both of the adjacent ones of the frame sections 14, 16, 18, and 20, thereby providing more support, for example, compared to transferring the force near a middle portion of a respective section body 48.

Figure 3:
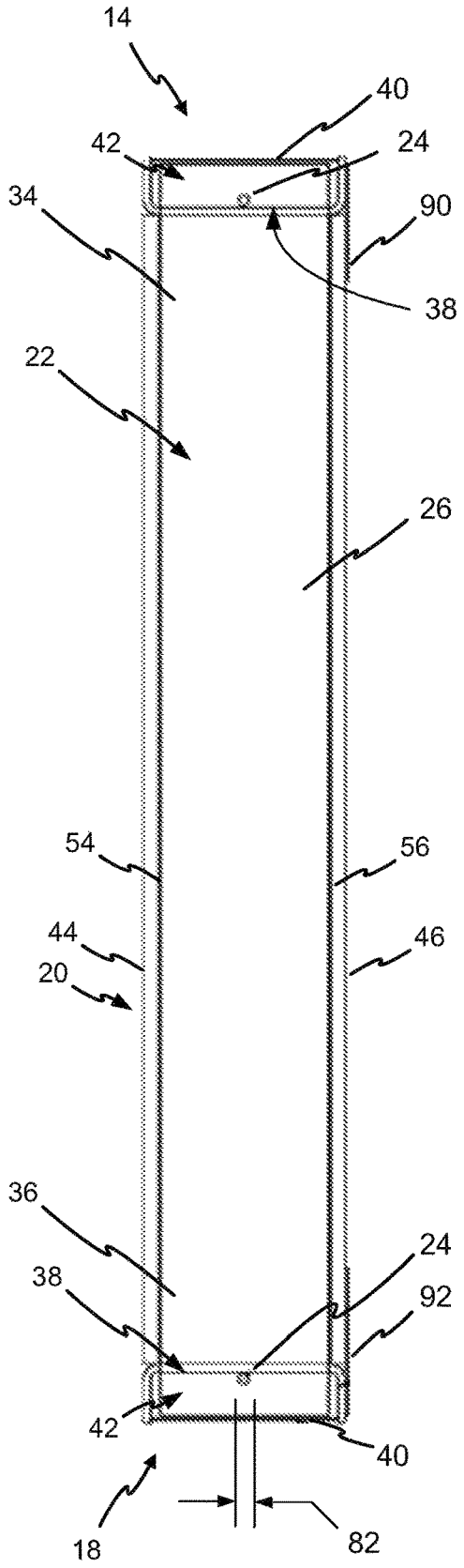
FIG. 3 is a cross-sectional view of the example louver along line 3-3 in FIG. 1.
Figure 4:
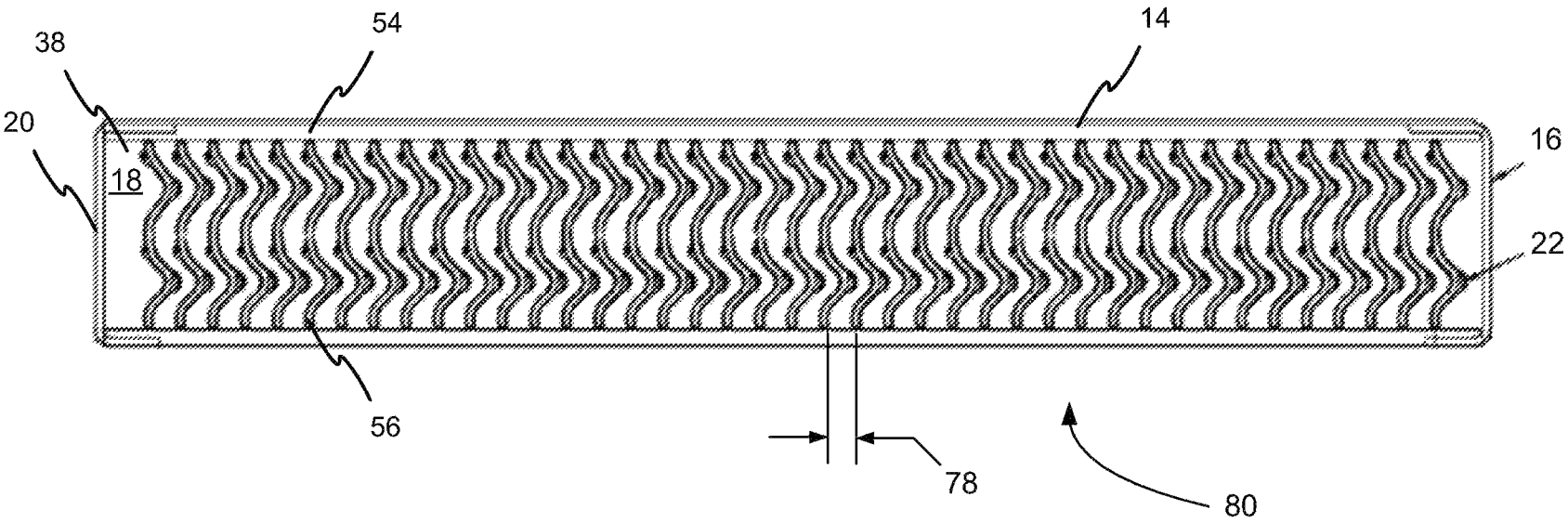
FIG. 4 is a cross-sectional of the example louver along line 4-4 in FIG. 1.
Figure 5:
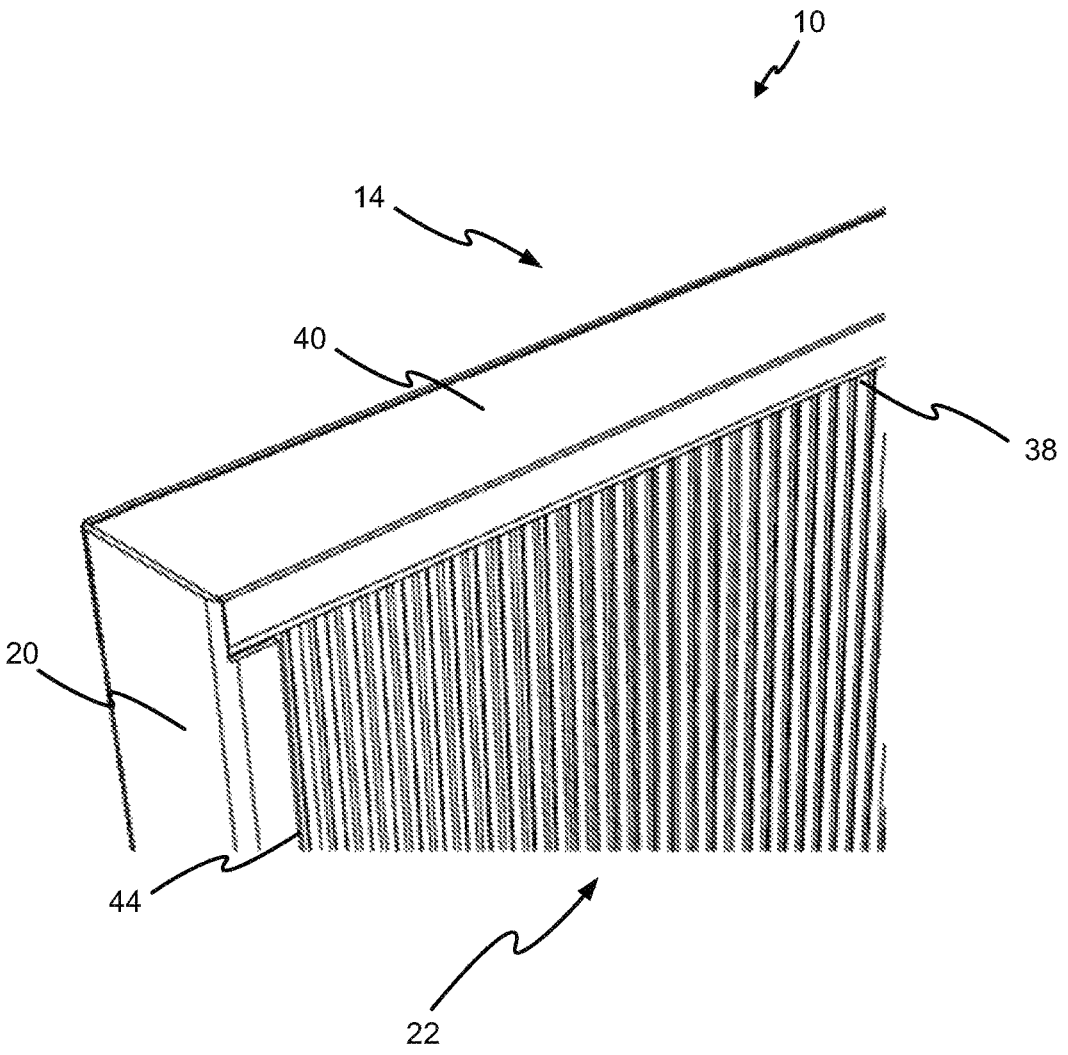
FIG. 5 is a partial top front perspective view of the louver of FIG. 1.

Referring specifically to FIGS. 3 and 4, for ease of assembly and/or efficient water drainage, the louver 10 may be constructed such that the plurality of louver blades 22 have one or more surfaces spaced apart from the frame 12. In an implementation, the louver 10 may be configured so that all or substantially all surfaces of the plurality of louver blades 22 are spaced apart from all surfaces of the frame 12. For example, the minimizing or avoiding of contact points between the frame 12 and the plurality of louver blades 22 minimizes or eliminates the impact on or interference with the water drainage that may be caused due to excessive contact. Also, for instance, this configuration may simplify assembly of the plurality of louver blades 22 within the frame 12 by limiting the number of fixed attachment points for connecting the plurality of louver blades 22 to the frame 12 to the number of member ends 30, 32 of the one or more elongated members 24. Further, this configuration may also simplify assembly of the frame 12, as this configuration enables the combination of the one or more elongated members 24 and the plurality of louver blades 22 to be a combined assembly, which may then be attached to respective sides of the frame 12, e.g. frame section 20 and then frame section 16. Contemporaneously, the assembly of the louver frame 12 may be completed by attaching the remaining sides of the frame 12, e.g., frame sections 14 and 18, which in some implementations may have already been threaded through the plurality of louver blades 22 prior to the fixed attachment of the one or more elongated members 24 to the opposing frame sections 16 and 20, as will be explained below in more detail. Thus, the edges, ends, and/or surfaces of the plurality of blades 22 may be spaced apart from any surfaces of the frame 12, and such spacing may enable the plurality of blades 22 to be moveable relative to and independent of the frame 12, e.g., during assembly, disassembly, and/or in response to an impact on one of more of the plurality of blades 22.

Additionally, for example additionally referring back to FIG. 1, the configuration of the plurality of louver blades 22 being spaced apart from the frame 12 may ensure a water drainage path directly from the plurality of louver blades 22 to a respective one of the frame sections 14, 16, 18, and 20. In an implementation, for example, the plurality of louver blades 22 may be oriented to extend vertically within the frame 12 such that captured water naturally drains down the body 26 of each of the plurality of blades 22, via gravitational force, thereby dripping from the bottom blade end 36 into the bottom frame section 18 and out of the louver 10 via one or more of the drainage holes 15.

More specifically, referring to FIGS. 3 and 4, for example, the leading or forward edge 54 and the trailing or aft edge 56 of the body 26 of each of the plurality of blades 22 is positioned with a spacing relative to the respective inner surface of the adjacent surfaces of the frame sections 14 and 18. Similarly, referring specifically to FIG. 4, the sides of the body 26 of the two louver blades at the opposite ends (e.g., left end and right end, as illustrated) of the plurality of louver blades 22 having a spacing from the respective inner surfaces of the frame sections 16 and 20.

Figure 7:
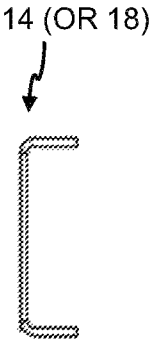
FIG. 7 is a side view of the example frame section of FIG. 6.
Figure 6:
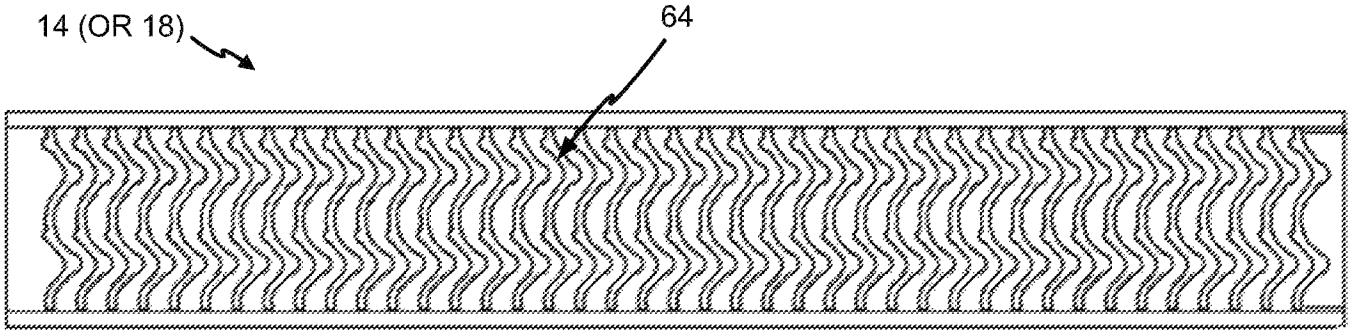
FIG. 6 is a top view of an example of frame section of the louver of FIG. 1, where this example frame section may be the same at both the top and bottom of the louver (but oriented as mirror images of one another)
Figure 8:
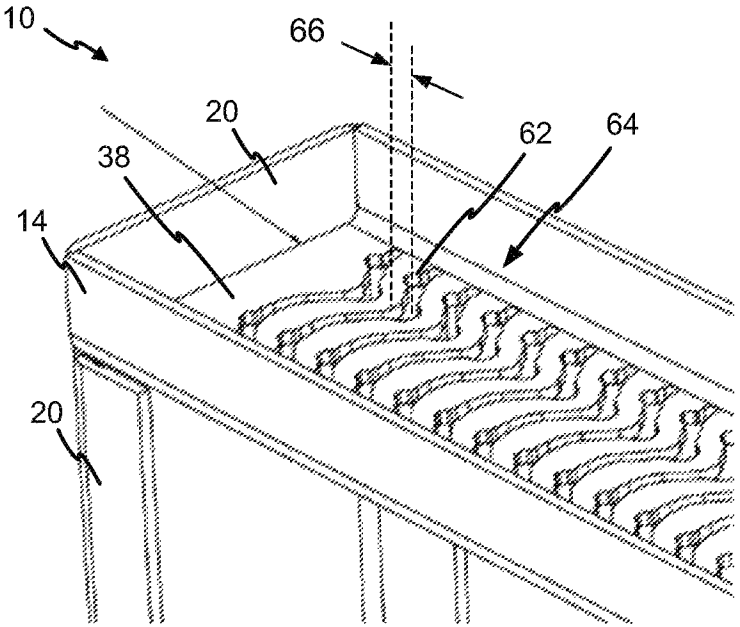
FIG. 8 is a partial top front perspective view of an example of the louver frame of the louver of FIG. 1, prior to being assembled with the plurality of louver blades, and including an inner wall of the louver frame having a plurality of slots for receiving the plurality of louver blades while maintaining a gap around the louver blades.

Moreover, specifically referring to FIGS. 6-8, in one implementation, the inner walls 38 of the respective frame sections (e.g., frame sections 14 and 18) adjacent to the blade ends 34 and 36 of the plurality of blades 22 include internal surfaces 62 defining a plurality of slots 64 having a shape corresponding to the shape of each of the plurality of blades 22. The plurality of slots 64 are sized to define a gap 66 larger than a corresponding thickness 68 (see FIG. 10) of the body 26 of each of the plurality of blades 22. The gap 66 thereby spaces apart the body 26 of each of the plurality of blades 22 from the inner surfaces 62 of each of the plurality of slots 22. This spacing enables easy assembly of the respective frame sections 14 and 18. This spacing also enables captured water to drain past the inner wall 38 of the bottom frame section (frame section 18) and out of the inner air passage area 13 (FIG. 1), reducing the chance that the entrained water re-enters the air passage area 13 as it will instead drip into the bottom frame section 18 and drain out of the louver 10 via one of the drainage holes 15.

It should be understood that other orientations of the plurality of louver blades 22 may be possible, e.g., horizontally positioned or acutely angled relative to a horizontal axis, although such configurations may include additional structures to direct the drainage of the entrained water out of the louver 10.

Figure 9:
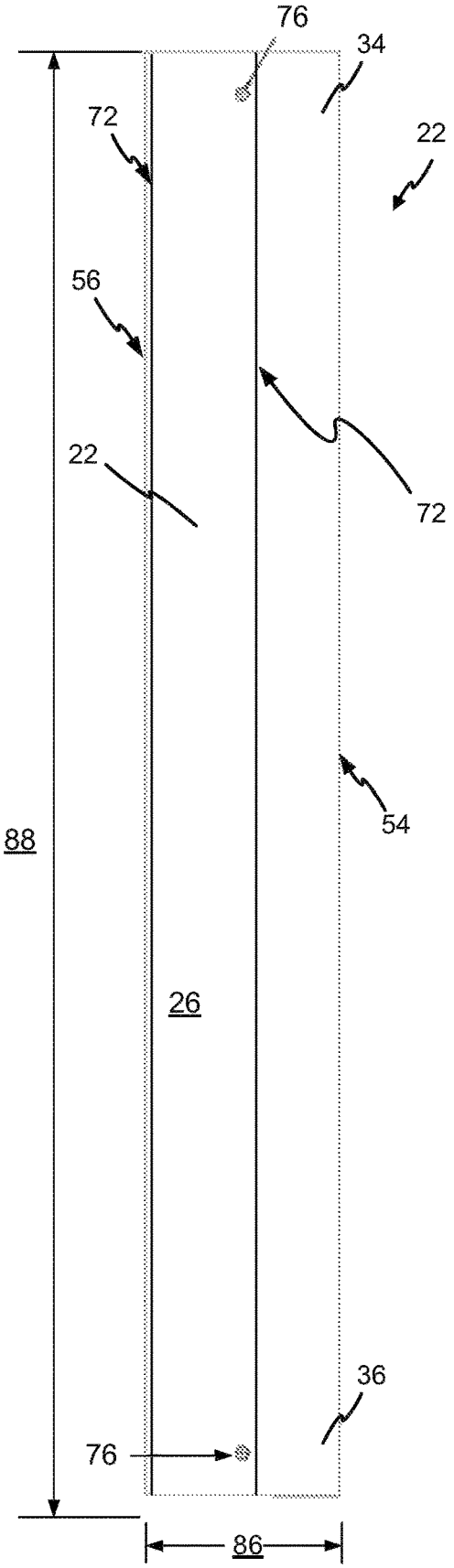
FIG. 9 is a side view of an example louver blade of the louver of FIG. 1.
Figure 10:
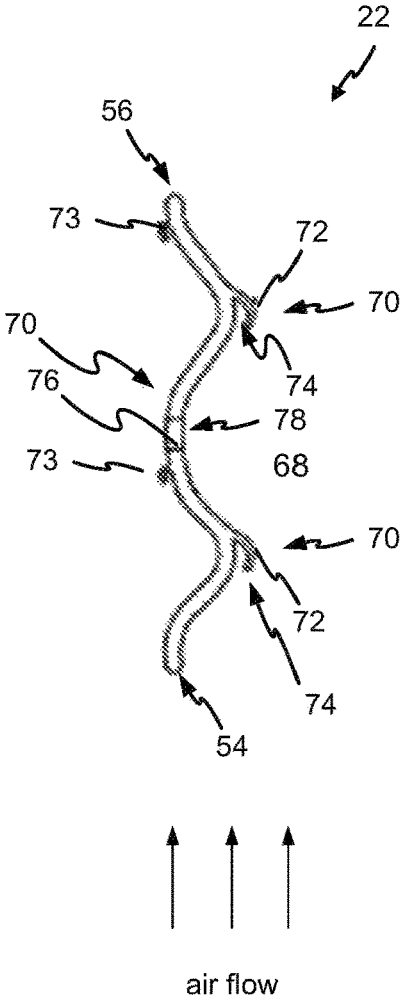
FIG. 10 is an end view of the example louver blade of the louver of FIG. 9.

Referring to FIGS. 9 and 10, the body 26 of each of the plurality of louver blades 22 may have a shape and/or one or more structures in the direction of the air flow configured to slow down air speed and trap wind-driven water to resist or prevent the passage of the water through the louver 10. For example, the body 26 may have a curved shape with one or more apexes 70 in the path of the air flow and one or more water capture members 72 extending from the body 16. In one implementation, the one or more water capture members 72 may be positioned at or near one or more of the apexes 70 and extend from the body 26 to capture water in the air. For instance, each water capture member 72 may have a hooked shape with the concave portion facing the direction of the air flow to define a pocket 74 within which water can collect. Each water capture member 72 may extend substantially the full length of each of the plurality of blades 22 such that the captured water drains to a respective blade end 34, 36, such as the bottom blade end 36 in FIG. 1. The body 26 may additionally include one or more mounting structures 73 to assist with mounting the blade 22 in the louver 10. It should be understood that while the example shape of the body 26 in these figures includes two apexes 70 and two water capture members 72 on a same side of the body 26, with another apex 70 on the opposite side and two mounting structures 73, other suitable designs may include more or less of such structures and on one or both sides of the body 26, depending on the particular application and water-driven rain resistance capabilities of the louver 10.

Additionally, the body 26 of each of the plurality of louver blades 22 may have one or more contact areas 76 where the respective one or more elongated members 24 contact and/or are affixed to the respective louver blade. In one implementation, for example, each contact area 76 is defined by an inner wall in the body 26 of each of the plurality of louver blades 22, thereby defining a through hole 78 sized to receive the respective elongated member 24. In some cases, the respective elongated member 24 may then be fixedly attached to at least a subset if not all of the plurality of louver blades 22. The fixed attachment may include, but is not limited to, a weld, a mechanical fastener, a force fit, an adhesive, or any attachment mechanism or procedure suitable for joining the respective elongated member 24 to each of the plurality of louver blades 22.

Moreover, referring to FIG. 4, the sizing of the plurality of louver blades 22 and the one or more elongated members 24 may be configured to achieve a particular wind-driven rain resistance and/or impact resistance. For instance, the plurality of louver blades 22 may have a relative spacing 78 that defines a gap 80 between the louver blades through which air may flow. The spacing 78 may be increased or decreased depending on whether wind-driven rain resistance and/or impact resistance is desired to be increased or decreased, respectively, and also depending on a desired pressure drop across the louver 10. Also, referring to FIG. 3, a cross-sectional size or area 82 of the one or more elongated members 24, and a thickness 68 of the body 26 of the plurality of blades 22, may be increased or decreased to respectively increase or decrease impact resistance. Also, referring to FIG. 9, a depth 86 of the plurality of louver blades 22 along with the number of apexes 70 may be increased or decreased to increase or decrease, respectively wind-driver rain resistance. The depth 86 defines a longitudinally extending distance along a first axis between the leading or forward edge 54 and the trailing or aft edge 56 of the body 26, wherein the first axis is substantially perpendicular to second axis along which the body 26 extends between the blade ends 34 and 36 to define a length 88 of the body 26.

Figure 11:
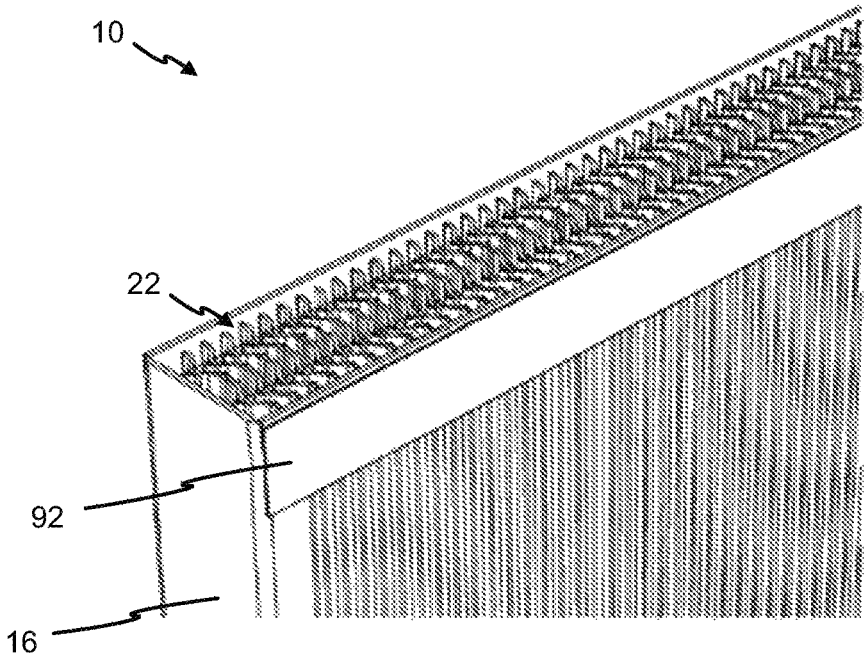
FIG. 11 is a partial top perspective view of an example of the louver frame of the louver of FIG. 1, with an outer frame wall removed, and including a water stop member at a top, aft side of the louver.

Referring to FIGS. 2, 3, and 11, the louver 10 may also include a head water stop member 90 and a sill water stop member 92 to resist or prevent water that may collect on the inner surfaces of the first frame section 14 and the third frame section 18 from passing through the louver 10. In this case, the first frame section 14 may also be referred to as a head frame, and the third frame section 18 may also be referred to as a sill frame. The head water stop member 90 and the sill water stop member 92 may be substantially planar members that extend across a width of the louver 10 and from the respective one of the first frame section 14 and the third frame section 18 into the inner air passage area 13. The distance the head water stop member 90 and the sill water stop member 92 extend into the inner air passage area 13 may be any distance determined to be suitable to resist or prevent passage of any water that may collect on the respective inner surfaces of the first frame section 14 and the third frame section 18 through the louver 10.

Thus, as described herein, the present disclosure provides the louver 10 configured for improved resistance to wind-driven rain and impacts by foreign materials.

Example Implementations

As described above, the louver of the present disclosure may include any of a number of different features depending on the particular application or installation requirements. Examples of such different configurations include one or more of the following.

In one implementation, a louver includes a frame that forms an enclosure defining an opening, and a plurality of louver blades disposed within the opening. The louver further includes at least one elongated member disposed within the frame and in contact with the plurality of louver blades. The at least one elongated member has a body that longitudinally extends between a first member end and a second member end, wherein the first member end and the second member end are fixedly connected to opposing sections of the frame.

In an optional or additional aspect, the at least one elongated member may be fixedly connected to each of the plurality of louver blades.

In an optional or additional aspect, the frame may include one or more inner surfaces, and the plurality of blades may include one or more edges and one or more ends that are spaced apart from the one or more inner surfaces of the frame.

In an optional or additional aspect, the at least one elongated member may be fixedly connected through a body of each of the plurality of louver blades, wherein the frame includes one or more inner surfaces, and wherein the plurality of blades include one or more edges and one or more ends that are spaced apart from the one or more inner surfaces of the frame.

In an optional or additional aspect, the plurality of louver blades each may have a blade body that extends along a first axis between a first edge and a second edge, wherein the first axis is substantially perpendicular to a second axis along which the body of the at least one elongated member longitudinally extends, and the at least one elongated member may be fixedly connected to a middle portion between the first edge and the second edge of the body of each of the plurality of louver blades.

In an optional or additional aspect, the plurality of louver blades may each have a blade body that longitudinally extends in a first axis between a first blade end and a second blade end, wherein the first axis is substantially perpendicular to a second axis in which the body of the at least one elongated member longitudinally extends, and the at least one elongated member may be fixedly connected to each of the plurality of louver blades adjacent to one of the first blade end or the second blade end.

In an optional or additional aspect, the at least one elongated member may include a first elongated member and a second elongated member, wherein the body of each the first elongated member and the second elongated member longitudinally extends along a first axis that intersects the first frame section and the second frame section, the plurality of louver blades each may have a blade body that longitudinally extends along a second axis between a first blade end and a second blade end, wherein the second axis is substantially perpendicular to the first axis, the first elongated member may be fixedly connected to each of the plurality of louver blades adjacent to the first blade end, and the second elongated member may be fixedly connected to each of the plurality of louver blades adjacent the second blade end.

In an optional or additional aspect, the frame may include at least one inner surface having a plurality of slots sized to receive the plurality of louver blades while maintaining a spaced apart gap between the at least one inner surface and the plurality of louver blades.

In an optional or additional aspect, the frame may further comprise a third frame section and an opposing fourth frame section each having respective ends attached to the first frame section and the second frame section, wherein the third frame section and the fourth frame section each may include an inner wall, wherein each inner wall includes a plurality of inner surfaces that define a plurality of gaps sized to receive the plurality of louver blades, wherein the respective inner surfaces are spaced apart from top and bottom surfaces of the plurality of louver blades, and the plurality of louver blades each may have a blade body that longitudinally extends in a first direction between a first blade end and a second blade end, wherein the first blade end and the second blade end are respectively spaced apart from the first frame section and the second frame section.

In an optional or additional aspect, the blade body of each of the plurality of louver blades may include one or more apexes and one or more water capture members.

In an optional or additional aspect, the plurality of louver blades may be oriented vertically in the frame, wherein the frame further includes a third frame section at a bottom of the frame, and wherein the third frame section includes one or more internal walls defining one or more drainage holes.

In an optional or additional aspect, the frame may further include a third frame section and an opposing fourth frame section each connected at respective ends with corresponding ends of the first frame section and the second frame section to define an opening sized to receive the plurality of louver blades, the at least one elongated member may include a first elongated member and a second elongated member, wherein the body of each of the first elongated member and the second elongated member longitudinally extends between the first frame section and the second frame section, the plurality of louver blades each may have a blade body that longitudinally extends between a first blade end and a second blade end substantially perpendicular to the body of each of the first elongated member and the second elongated member, the first elongated member may be fixedly connected to each of the plurality of louver blades adjacent to the first blade end, and the second elongated member may be fixedly connected to each of the plurality of louver blades adjacent the second blade end.

In an optional or additional aspect, at least both of the third frame section and the fourth frame section may include an outer wall spaced apart from an inner wall to define a channel, and the first elongated member and the second elongated member may be respectively positioned within the respective channel of one of the third frame section and the fourth frame section.

In another implementation, a louver may include a frame including a first frame section and an opposing second frame section, and a third frame section and an opposing fourth frame section each connected at respective ends with corresponding ends of the first frame section and the second frame section to define an opening, a plurality of louver blades disposed within the opening of the frame, and at least one elongated member having a body that longitudinally extends between a first member end and a second member end through the plurality of louver blades, wherein the first member end is fixedly attached to the first frame section and the second member end is fixedly attached to the second frame section, and wherein the at least one elongated member is fixedly attached to each of the plurality of louver blades.

In an optional or additional aspect of this implementation, the frame may include one or more inner surfaces, and wherein the plurality of blades include one or more edges and one or more ends that are spaced apart from the one or more inner surfaces of the frame.

In an optional or additional aspect of this implementation, the plurality of louver blades may be oriented vertically in the frame, wherein the third frame section is positioned at a bottom of the frame and includes one or more internal walls defining one or more drainage holes.

In an optional or additional aspect of this implementation, the first frame section and the second frame section define first U-shaped structures having a concave side facing the opening, and wherein the third frame section and the fourth frame section define second U-shaped structures having a convex side facing the opening.

In an optional or additional aspect of this implementation, the third frame section and the fourth frame section may each include an inner wall, wherein each inner wall includes a plurality of inner surfaces that define a plurality of gaps sized to receive the plurality of louver blades, wherein the respective inner surfaces are spaced apart from top and bottom surfaces of the plurality of louver blades, and the plurality of louver blades may each have a blade body that longitudinally extends in a first direction between a first blade end and a second blade end, wherein the first blade end and the second blade end are respectively spaced apart from the first frame section and the second frame section.

It will be appreciated that various implementations of the above-disclosed and other features and functions, or alternatives or varieties thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A louver, comprising:

a frame that forms an enclosure defining an opening, the frame including a plurality of frame sections, wherein at least one frame section of the plurality of frame sections includes an outer wall spaced apart from an inner wall to define a channel;

a plurality of louver blades disposed within the opening; and an elongated member disposed within the frame and in contact with the plurality of louver blades, wherein the elongated member has a body that longitudinally extends between a first member end and a second member end, wherein the first member end and the second member end are fixedly connected to opposing sections of the frame, and wherein the elongated member is positioned within the channel of the at least one frame section.

2. The louver of claim 1, wherein the elongated member is fixedly connected to each of the plurality of louver blades.

3. The louver of claim 1, wherein the frame includes one or more inner surfaces, and the plurality of louver blades include one or more edges and one or more ends that are spaced apart from the one or more inner surfaces of the frame.

4. The louver of claim 1, wherein the elongated member is fixedly connected through a blade body of each of the plurality of louver blades, wherein the frame includes one or more inner surfaces, and wherein the plurality of louver blades include one or more edges and one or more ends that are spaced apart from the one or more inner surfaces of the frame.

5. The louver of claim 1, wherein the plurality of louver blades each have a blade body that extends along a first axis between a first edge and a second edge, wherein the first axis is substantially perpendicular to a second axis along which the body of the elongated member longitudinally extends; and wherein the elongated member is fixedly connected to a middle portion between the first edge and the second edge of the body of each of the plurality of louver blades.

6. The louver of claim 1, wherein the plurality of louver blades each have a blade body that longitudinally extends in a first axis between a first blade end and a second blade end, wherein the first axis is substantially perpendicular to a second axis in which the body of the elongated member longitudinally extends; and wherein the elongated member is fixedly connected to each of the plurality of louver blades adjacent to one of the first blade end or the second blade end.

7. The louver of claim 1, wherein the frame includes at least a first frame section and a second frame section opposing the first frame section;

wherein the first frame section and the second frame section are respectively attached to the first member end and the second member end;

wherein the elongated member includes a first elongated member and a second elongated member, wherein the body of each the first elongated member and the second elongated member longitudinally extends along a first axis that intersects the first frame section and the second frame section;

wherein the plurality of louver blades each have a blade body that longitudinally extends along a second axis between a first blade end and a second blade end, wherein the second axis is substantially perpendicular to the first axis;

wherein the first elongated member is fixedly connected to each of the plurality of louver blades adjacent to the first blade end; and wherein the second elongated member is fixedly connected to each of the plurality of louver blades adjacent the second blade end.

8. The louver of claim 1, wherein the frame includes at least one inner surface having a plurality of slots sized to receive the plurality of louver blades while maintaining a spaced apart gap between the at least one inner surface and the plurality of louver blades.

9. The louver of claim 1, wherein the frame includes a first frame section and a second frame section opposing the first frame section;

wherein the first frame section and the second frame section are respectively attached to the first member end and the second member end;

wherein the frame further comprises a third frame section and a fourth frame section opposing the third frame section, each of the third frame section and the fourth frame section having respective ends attached to the first frame section and the second frame section, wherein the third frame section and the fourth frame section each include an inner wall, wherein each inner wall includes a plurality of inner surfaces that define a plurality of gaps sized to receive the plurality of louver blades, wherein the respective inner surfaces are spaced apart from top and bottom surfaces of the plurality of louver blades; and wherein the plurality of louver blades each have a blade body that longitudinally extends in a first direction between a first blade end and a second blade end, wherein the first blade end and the second blade end are respectively spaced apart from the first frame section and the second frame section.

10. The louver of claim 9, wherein the blade body of each of the plurality of louver blades includes one or more apexes and one or more water capture members.

11. The louver of claim 1, wherein the plurality of louver blades are oriented vertically in the frame, wherein the frame further includes a third frame section at a bottom of the frame, and wherein the third frame section includes one or more internal walls defining one or more drainage holes.

12. The louver of claim 1, wherein the frame includes at least a first frame section of the plurality of frame sections and a second frame section of the plurality of frame sections opposing the first frame section, the first frame section and the second frame section respectively attached to the first member end and the second member end;

wherein the frame further includes a third frame section of the plurality of frame sections and a fourth frame section of the plurality of frame sections opposing the third frame section, each of the third frame section and the fourth frame section connected at respective ends with corresponding ends of the first frame section and the second frame section to define an opening sized to receive the plurality of louver blades;

wherein the elongated member includes a first elongated member and a second elongated member, wherein the body of each of the first elongated member and the second elongated member longitudinally extends between the first frame section and the second frame section;

wherein the plurality of louver blades each have a blade body that longitudinally extends between a first blade end and a second blade end substantially perpendicular to the body of each of the first elongated member and the second elongated member;

wherein the first elongated member is fixedly connected to each of the plurality of louver blades adjacent to the first blade end; and wherein the second elongated member is fixedly connected to each of the plurality of louver blades adjacent the second blade end.

13. The louver of claim 12, wherein at least both of the third frame section and the fourth frame section include an outer wall spaced apart from an inner wall to define the channel, and wherein the first elongated member and the second elongated member are respectively positioned within the respective channel of one of the third frame section or the fourth frame section.

14. A louver, comprising:

a frame including a first frame section and a second frame section opposing the first frame section, and a third frame section and a fourth frame section opposing the third frame section, each of the third frame section and the fourth frame section connected at respective ends with corresponding ends of the first frame section and the second frame section to define an opening;

a plurality of louver blades disposed within the opening of the frame; and an elongated member disposed within the opening and having a body that longitudinally extends between a first member end and a second member end through the plurality of louver blades, wherein the first member end is fixedly attached to the first frame section and the second member end is fixedly attached to the second frame section, and wherein the elongated member is fixedly attached to each of the plurality of louver blades, wherein at least one of the third frame section or the fourth frame section include an outer wall spaced apart from an inner wall to define a channel, and wherein the elongated member is positioned within the channel of the at least one of the third frame section or the fourth frame section.

15. The louver of claim 14, wherein the frame includes one or more inner surfaces, and wherein the plurality of louver blades include one or more edges and one or more ends that are spaced apart from the one or more inner surfaces of the frame.

16. The louver of claim 14, wherein the plurality of louver blades are oriented vertically in the frame, wherein the third frame section is positioned at a bottom of the frame and includes one or more internal walls defining one or more drainage holes.

17. The louver of claim 14, wherein the first frame section and the second frame section define first U-shaped structures having a concave side facing the opening, and wherein the third frame section and the fourth frame section define second U-shaped structures having a convex side facing the opening.

18. The louver of claim 17, wherein the third frame section and the fourth frame section each include an inner wall, wherein each inner wall includes a plurality of inner surfaces that define a plurality of gaps sized to receive the plurality of louver blades, wherein the respective inner surfaces are spaced apart from top and bottom surfaces of the plurality of louver blades; and wherein the plurality of louver blades each have a blade body that longitudinally extends in a first direction between a first blade end and a second blade end, wherein the first blade end and the second blade end are respectively spaced apart from the first frame section and the second frame section.

* * * * *